US008070017B2

(12) United States Patent
Green

(10) Patent No.: US 8,070,017 B2
(45) Date of Patent: Dec. 6, 2011

(54) UNIFIED MOUNTING CUP AND VALVE STEM ASSEMBLY

(76) Inventor: Ronald D. Green, Pataskala, OH (US)

( * ) Notice: Subject to any disclaimer, the term of this patent is extended or adjusted under 35 U.S.C. 154(b) by 763 days.

(21) Appl. No.: 12/150,300

(22) Filed: Apr. 28, 2008

(65) Prior Publication Data

US 2009/0266850 A1 Oct. 29, 2009

(51) Int. Cl.
*B67D 7/70* (2010.01)

(52) U.S. Cl. ..... 222/136; 222/94; 222/95; 222/105; 222/386.5; 222/402.1; 220/619; 239/337; 239/573

(58) Field of Classification Search ..... 239/337, 239/573; 220/619; 222/321.4, 321.6, 386.5, 222/394, 402.1, 402.15, 402.21–402.22, 222/509, 635, 94–95, 105, 135–136
See application file for complete search history.

(56) References Cited

U.S. PATENT DOCUMENTS 4,251,032 A * 2/1981 Werding ..... 239/323
4,735,349 A * 4/1988 Diamond et al. ..... 222/402.1
5,385,303 A * 1/1995 Gosselin et al. ..... 239/394
5,927,563 A * 7/1999 Kellner ..... 222/402.22

* cited by examiner

*Primary Examiner* — Kevin P Shaver
*Assistant Examiner* — Andrew Bainbridge
(74) *Attorney, Agent, or Firm* — Law Offices of Richard L. Huff

(57) ABSTRACT

A unified assembly of a mounting cup and valve stem assembly for aerosol containers. The mounting cup contains a flat central portion having an inner section extending downward from its periphery. An outer section extends upward from the lower edge of the inner section and abuts the inner section. The inner and outer sections constitute the lower wall. The outer section extends above the flat central portion and ends in a channel which can fit onto the bead of an aerosol container. The flat central portion has at least one hole through it. The valve stem assembly contains a flat circular upper piece having holes corresponding to those in the mounting cup. The holes are the open top ends of chambers for springs and plungers. Valve stems are below the chamber. The lower wall of the mounting cup is crimped to hold the mounting cup to the valve stem assembly.

10 Claims, 16 Drawing Sheets

UNIFIED MOUNTING CUP AND VALVE STEM ASSEMBLY

CROSS-REFERENCE TO RELATED APPLICATIONS

N/A

STATEMENT REGARDING FEDERALLY SPONSORED RESEARCH OR DEVELOPMENT (Not Applicable)

REFERENCE TO SEQUENTIAL LISTING, A TABLE, OR A COMPUTER PROGRAM LISTING APPENDIX SUBMITTED ON A COMPACT DISC (Not applicable)

BACKGROUND OF THE INVENTION

1) Field of the Invention

This invention relates to unified mounting cups and valve stem assemblies for aerosol containers. More particularly, this invention relates to unified mounting cups and valve stem assemblies suitable for use with multi-valve aerosol containers.

2) Description of the Related Art

Aerosol containers are widely used to package a variety of fluid materials, both liquid and powdered particulate products. Typically, the product and a propellant are confined within the container at above atmospheric pressure and the product is released from the container by manually opening a dispensing valve to cause the pressure within the container to deliver the product through the valve and connecting conduits to a discharge orifice.

In aerosol containers of the related art, the dispensing valve, crimped to a mounting cup having a sealing gasket, is normally mounted in a top opening of the container, which opening is defined by a component commonly referred to as the "bead" of the container opening. The mounting cup includes a central pedestal portion for crimping the dispensing valve, a profile portion extending outward from the pedestal portion, which profile portion merges into an upwardly extending body portion, the body portion merging into a channel portion terminating in a skirt portion, which channel is configured to receive the bead portion of the container opening. The sealing gasket normally is disposed within the channel portion and in many gasket configurations extends downward along a part of the body portion. After the sealing gasket is disposed onto the mounting cup, the cup is positioned onto the container and the cup is crimped to the container. The crimping operation is well-known to those skilled in the aerosol container art.

In a conventional form of aerosol valve assembly, a vertically acting aerosol valve is opened to release product in the aerosol container by downwardly depressing an actuator attached to the top of the upstanding stem of the aerosol valve body. When the actuator is released, the valve is closed by a spring acting upwardly against the valve plunger. The valve stem has an upwardly extending discharge passage, a groove extending about the stem periphery, a lateral valve orifice (one or more) extending through the stem wall into the groove, and a stem-encircling sealing gasket for fitting into the groove and closing the lateral orifice except when the valve is actuated to depress the stem lateral orifice below the gasket.

Multi-valve aerosol dispensers embodying the above features are known in the art, as see U.S. Pat. No. 7,036,685 issued to Green May 2, 2006, which is incorporated herein by reference.

A prior disclosure of conventional one-inch mounting cups containing single and multiple valve stems is made in U.S. Pat. No. 6,736,288 issued to Green May 18, 2004, which is incorporated herein by reference.

BRIEF SUMMARY OF THE INVENTION

In prior art mounting cups, a considerable amount of the available space is taken up by the profile portion and there is little room on the top of the pedestal portion for anything other than a single actuator. This invention seeks to solve that problem by allowing the entire area of the mounting cup to be available for actuators.

This invention relates to improved unified mounting cups and valve stem assemblies for aerosol containers. The mounting cups are of the conventional size so as to fit into a one-inch diameter hole. They may contain a single hole for an actuator or multiple holes for multiple actuators. The mounting cups are made of a single piece and contain a flat central cover for receiving one or more actuators and a downwardly directed inner section which is turned sharply into an upwardly directed outer section. The upwardly directed outer section extends above the flat central cover and forms a curved perimeter which will be crimped to the bead of the aerosol container. The combination of the downwardly extending and upwardly extending sections below the central cover is referred to as the lower wall. The lower wall is suitable for being crimped to the flat circular upper piece of the valve stem assembly described below.

The valve stem assembly contains a flat circular upper piece which fits against the lower surface of the flat central cover of the mounting cup. The upper piece contains at least one hole therein for the passage of the aerosol product(s). Beneath the upper piece and attached thereto is at least one valve body for the spring and appropriate valve plunger. Beneath each valve body is a valve stem which may be attached to a bag or a dip tube or may be free.

To prepare a unified mounting cup and valve stem assembly, each valve body of the valve stem assembly is equipped with the appropriate spring and valve plunger and a gasket is attached as in conventional valve stem assemblies. The mounting cup and the valve stem assembly are brought together with the holes of the valve stem assembly and the mounting cup being aligned. The lower wall of the mounting cup is crimped to the upper piece of the valve stem assembly.

The channel of the mounting cup may be crimped to the bead surrounding the one-inch hole in a dome for an aerosol container. The valve stem(s) may then be attached to appropriate collapsible bags or dip tubes. Any collapsible bags may be filled with the desired product. The dome of the thus-prepared assembly may then be secured to the top edge of an aerosol container. Aerosol propellant may be introduced into the container and the actuators and mixing device may be secured.

DETAILED DESCRIPTION OF THE INVENTION

Figure 1:
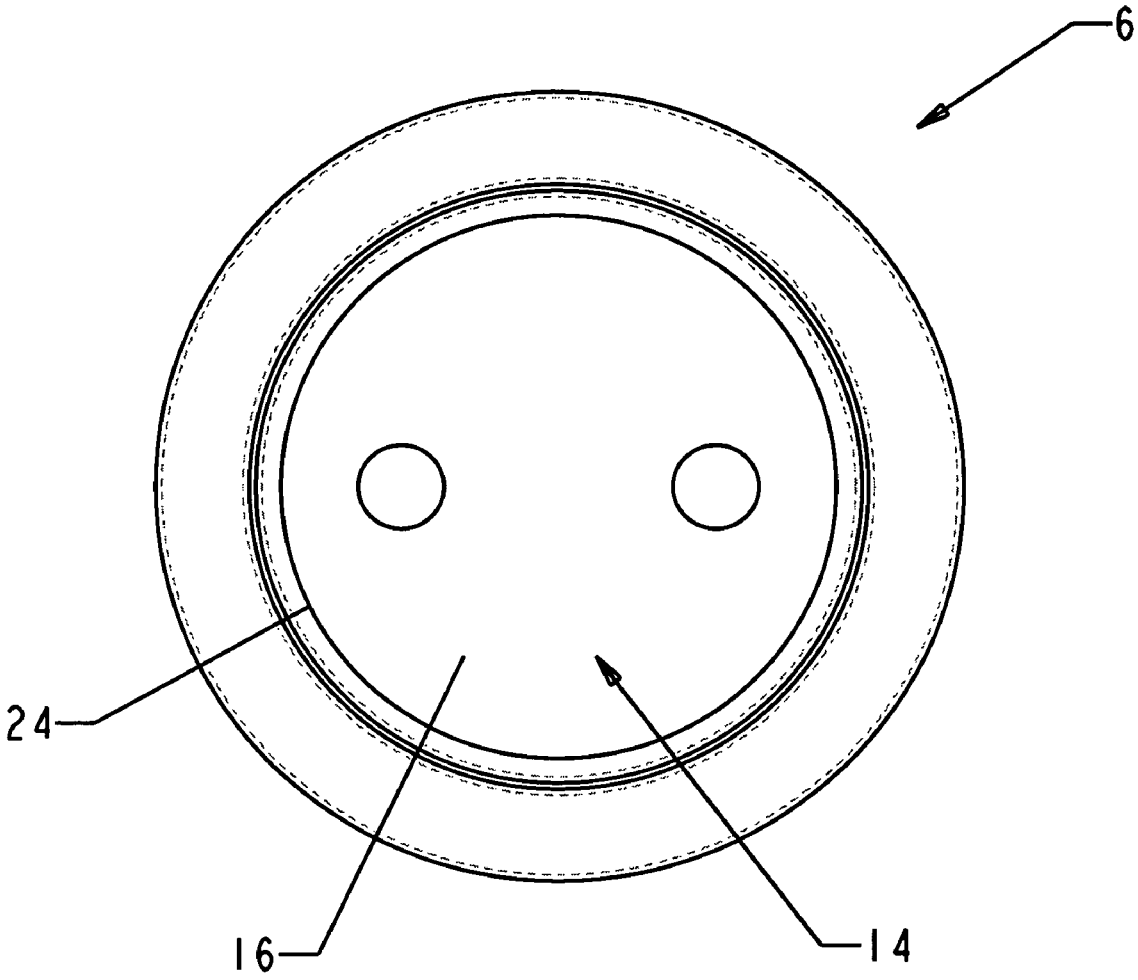
FIG. 1 is a plan view of the mounting cup according to this invention having two round openings in the central portion.
Figure 2:
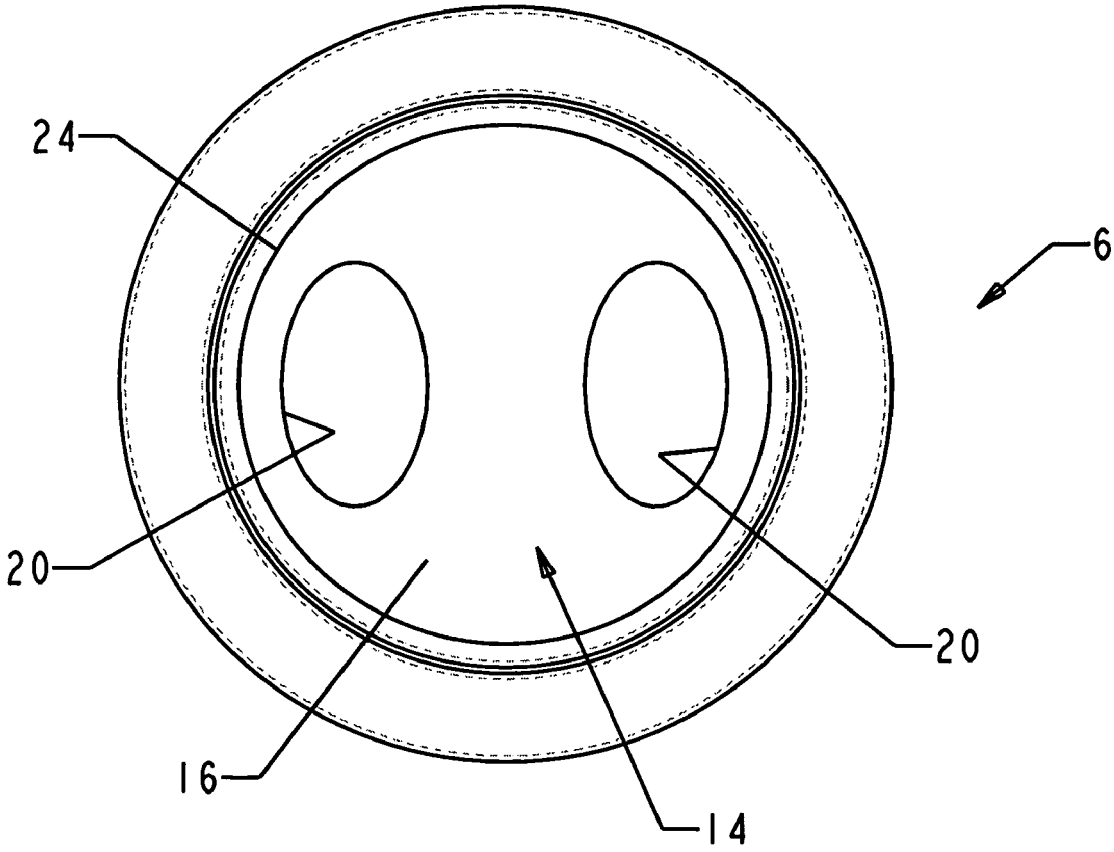
FIG. 2 is a plan view of the mounting cup according to this invention having two oval openings in the central portion.
Figure 3:
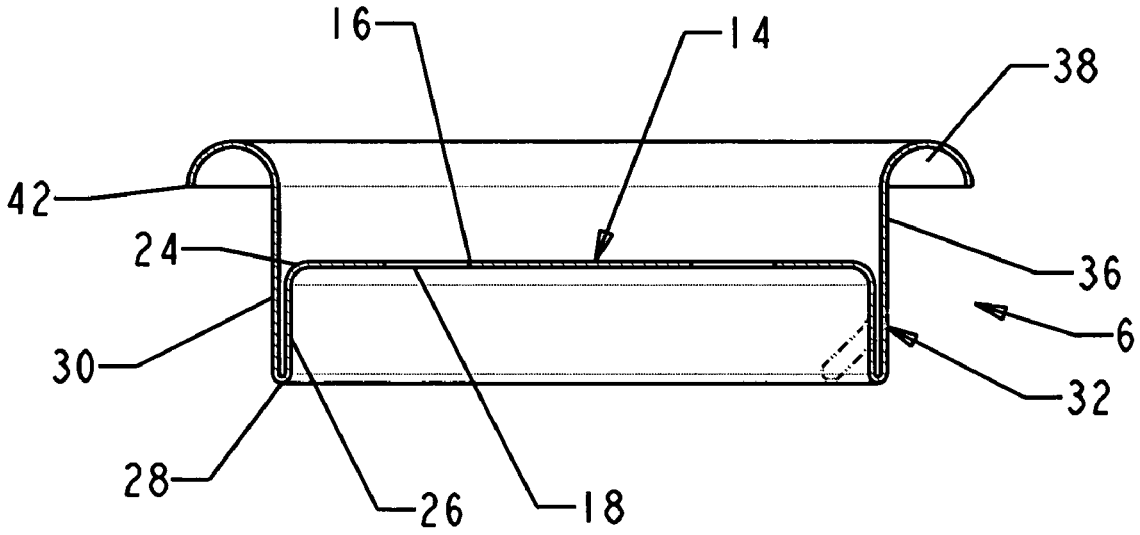
FIG. 3 is a side view of the mounting cup of this invention with ghost lines showing the location of crimping.
Figure 4:
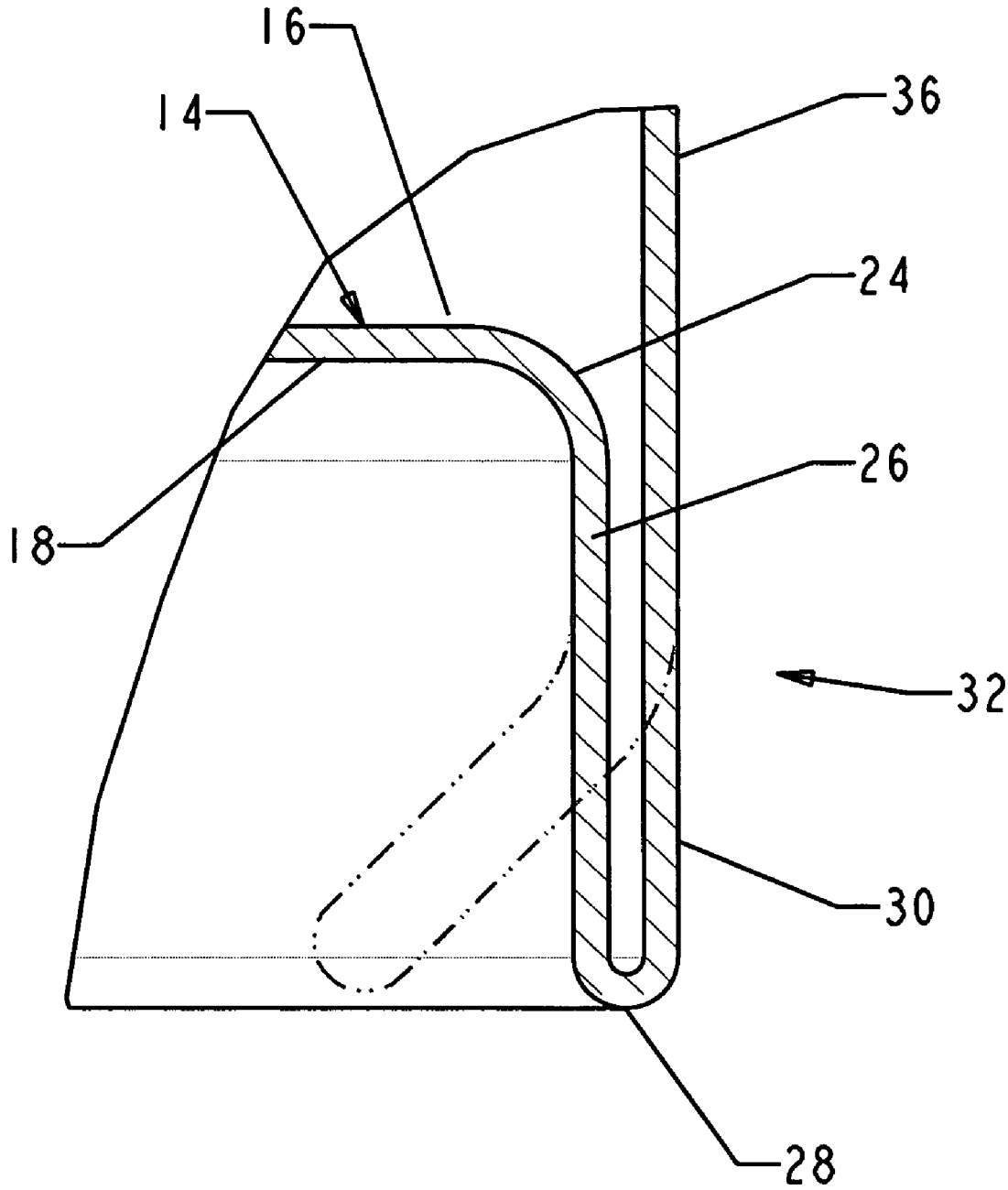
FIG. 4 is an enlarged view of the area for crimping shown in FIG. 3.
Figure 5:
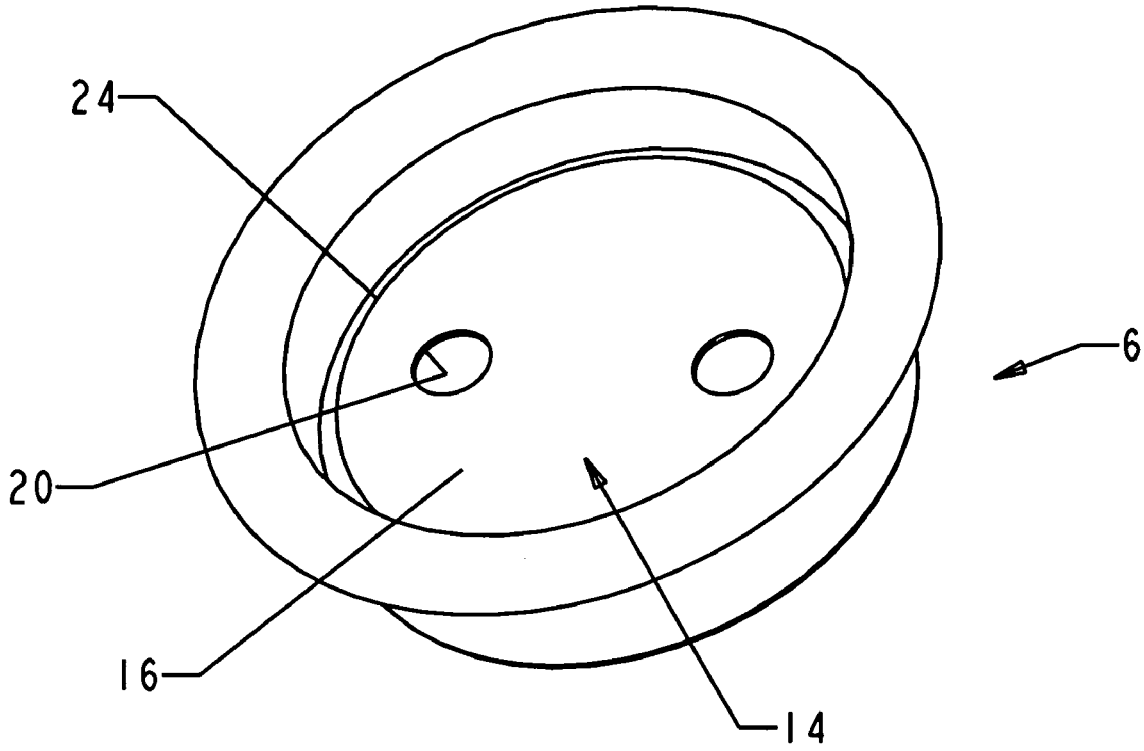
FIG. 5 is a top elevational perspective view of the mounting cup of this invention.
Figure 6:
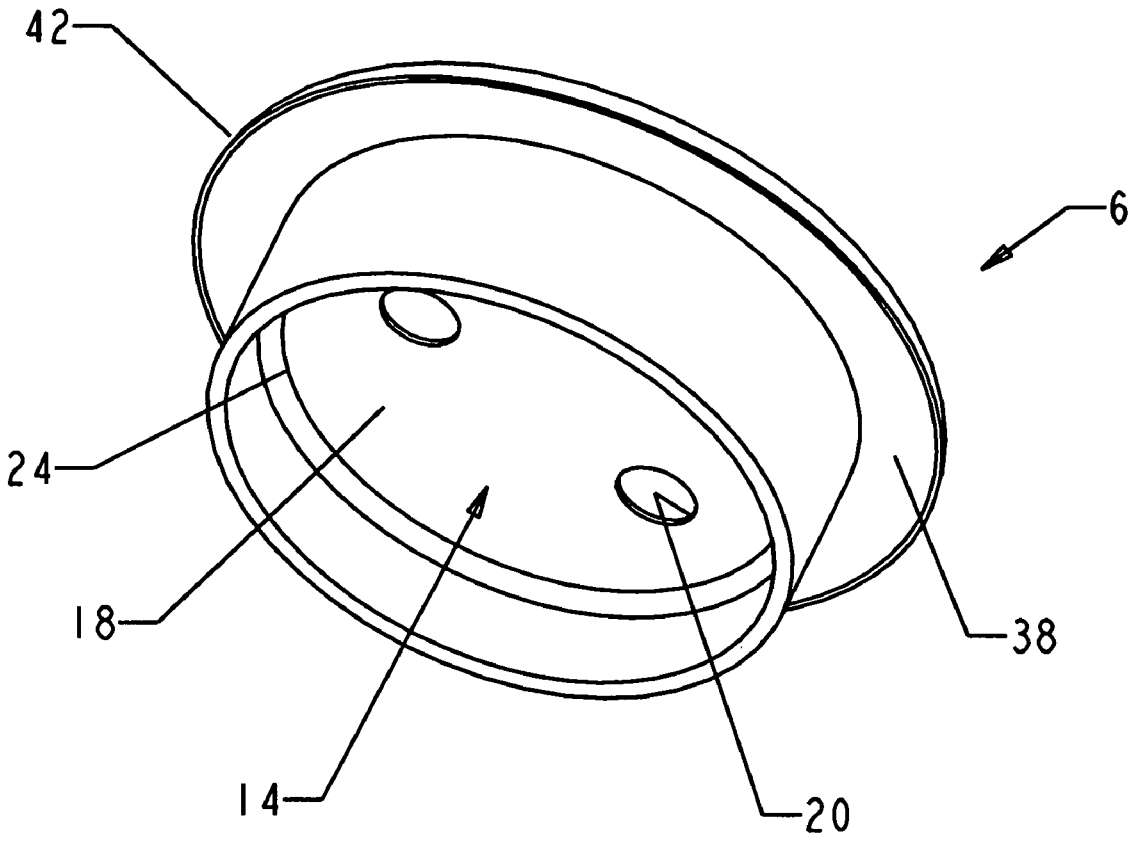
FIG. 6 is a bottom elevational perspective view of the mounting cup of this invention.
Figure 7:
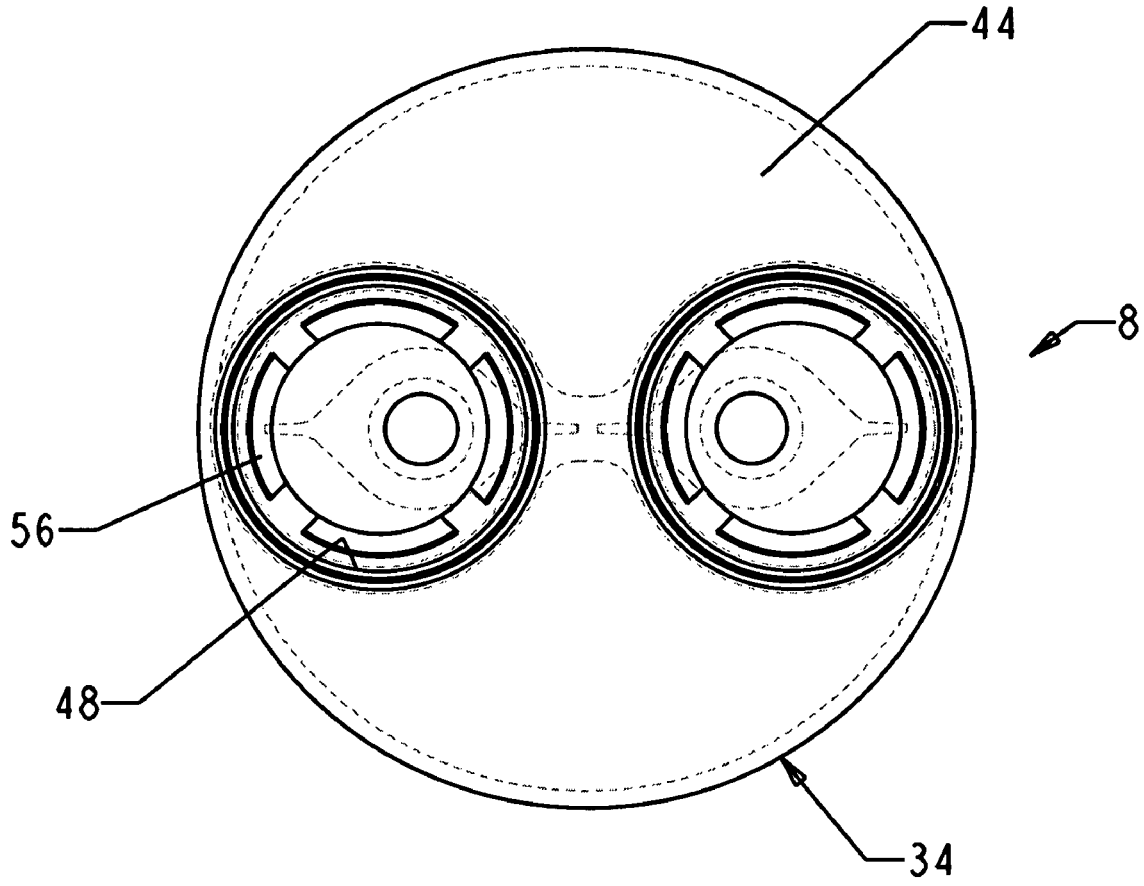
FIG. 7 is a plan view of the valve stem assembly according to this invention having two round openings.
Figure 8:
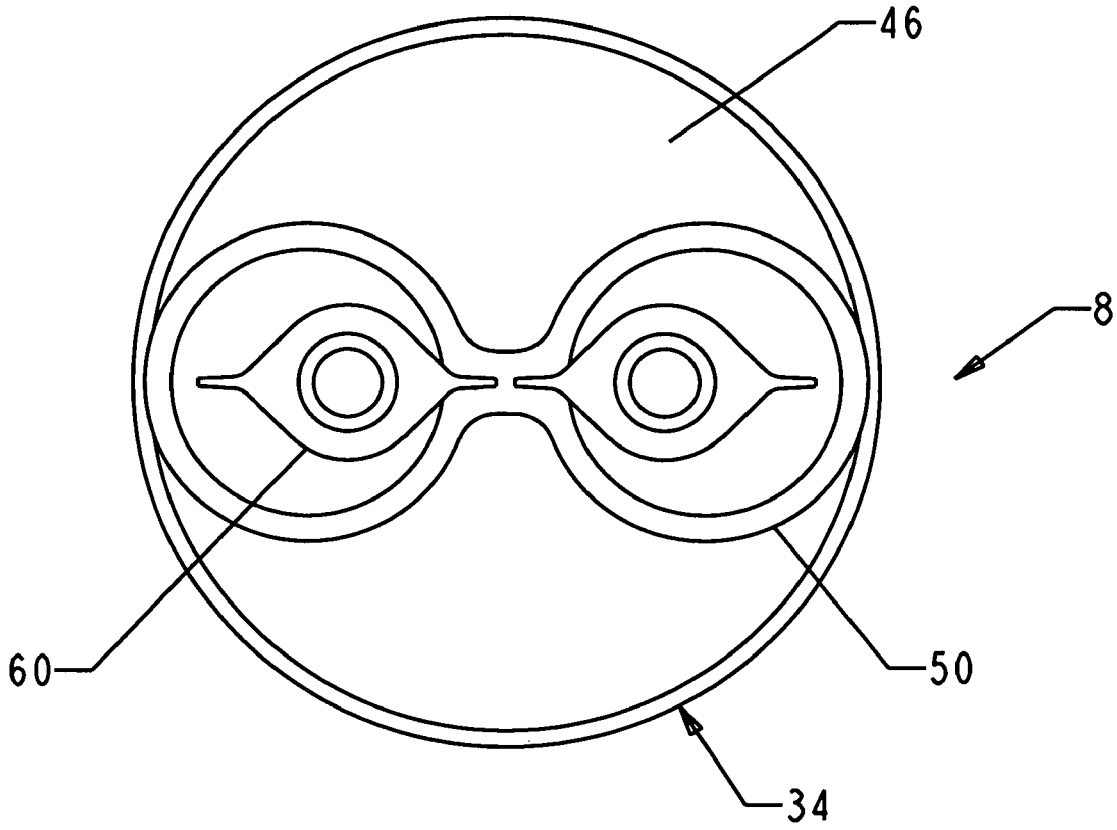
FIG. 8 is a bottom elevational view of the valve stem assembly according to this invention having two round openings.
Figure 9:
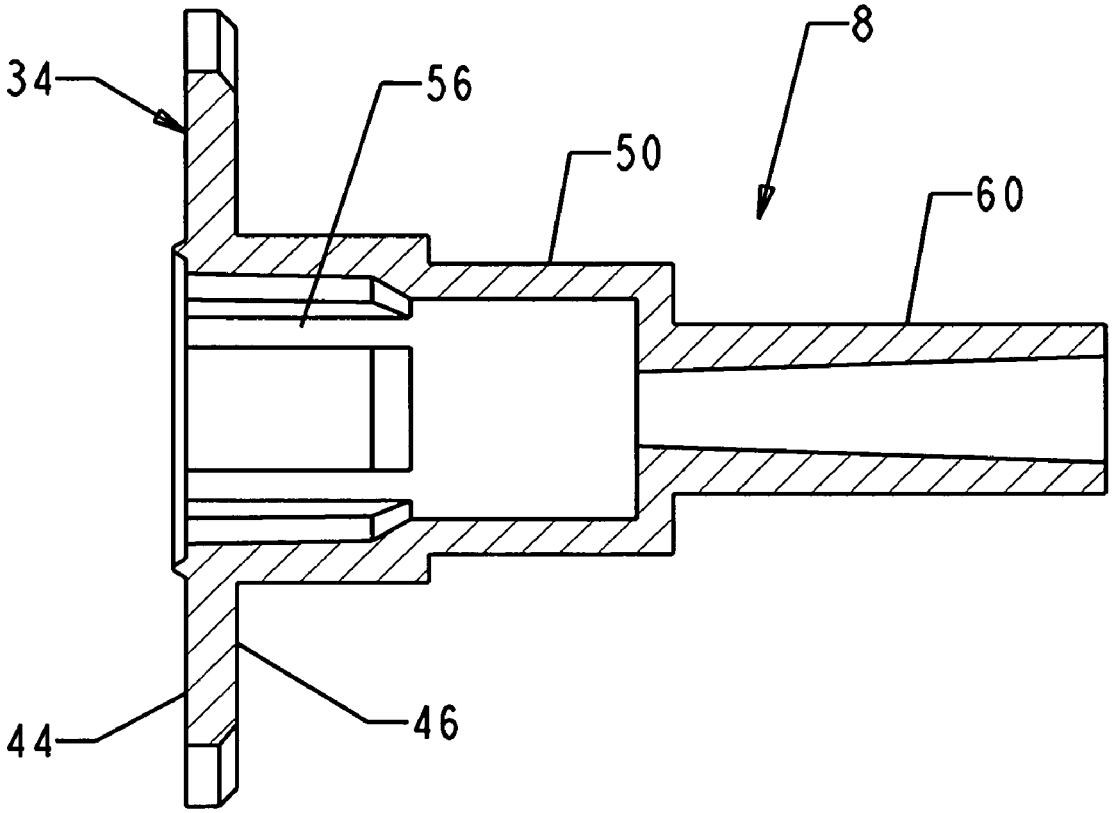
FIG. 9 is a side cross-sectional view of the valve stem assembly according to this invention.
Figure 10:
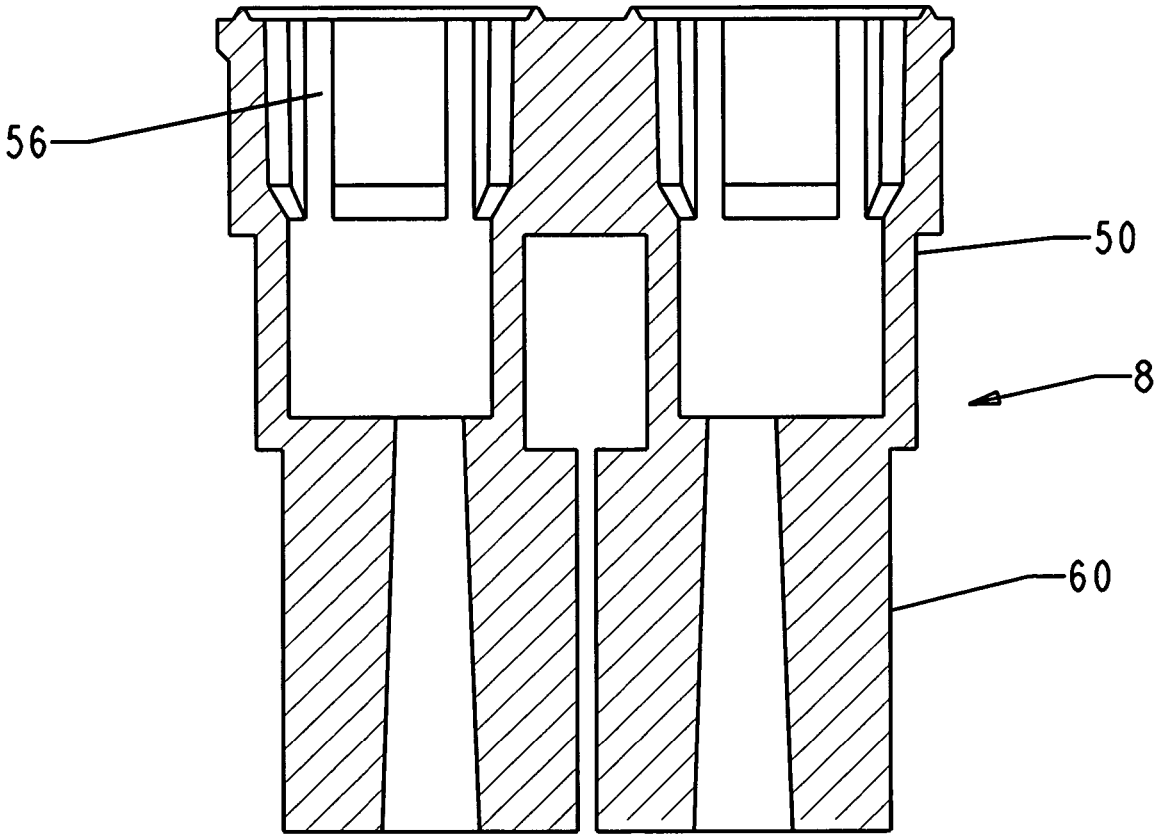
FIG. 10 is a front cross-sectional view of the valve stem assembly according to this invention.
Figure 11:
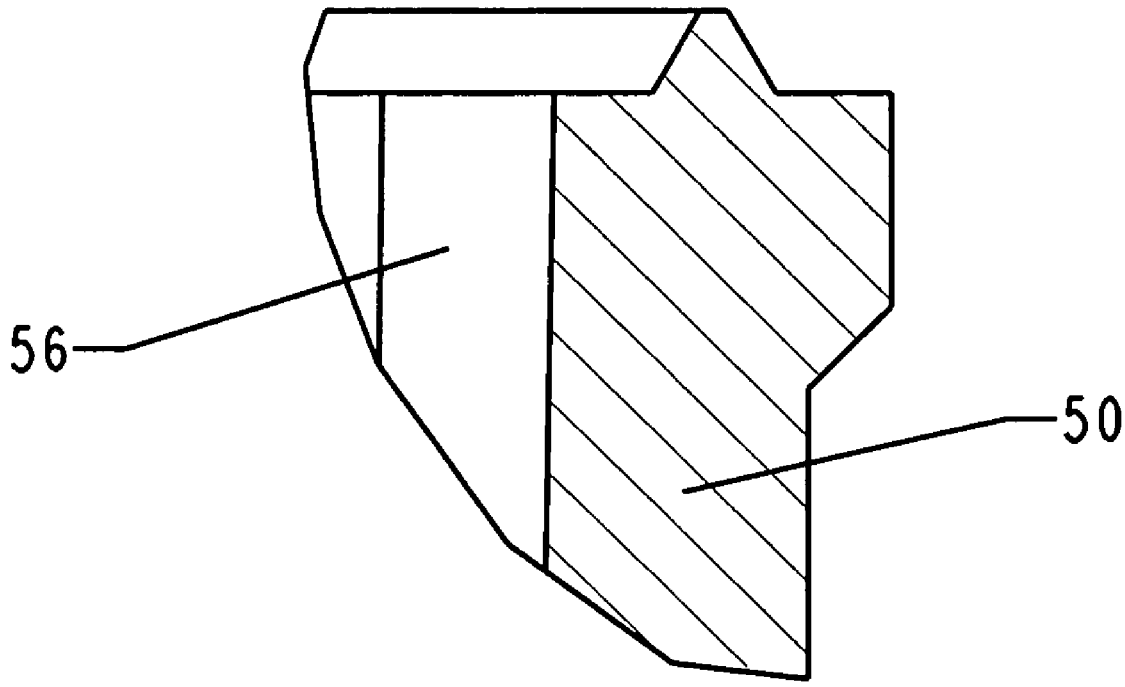
FIG. 11 is an enlarged cross-sectional view of the upper right corner of the valve stem assembly as shown in FIG. 10.
Figure 12:
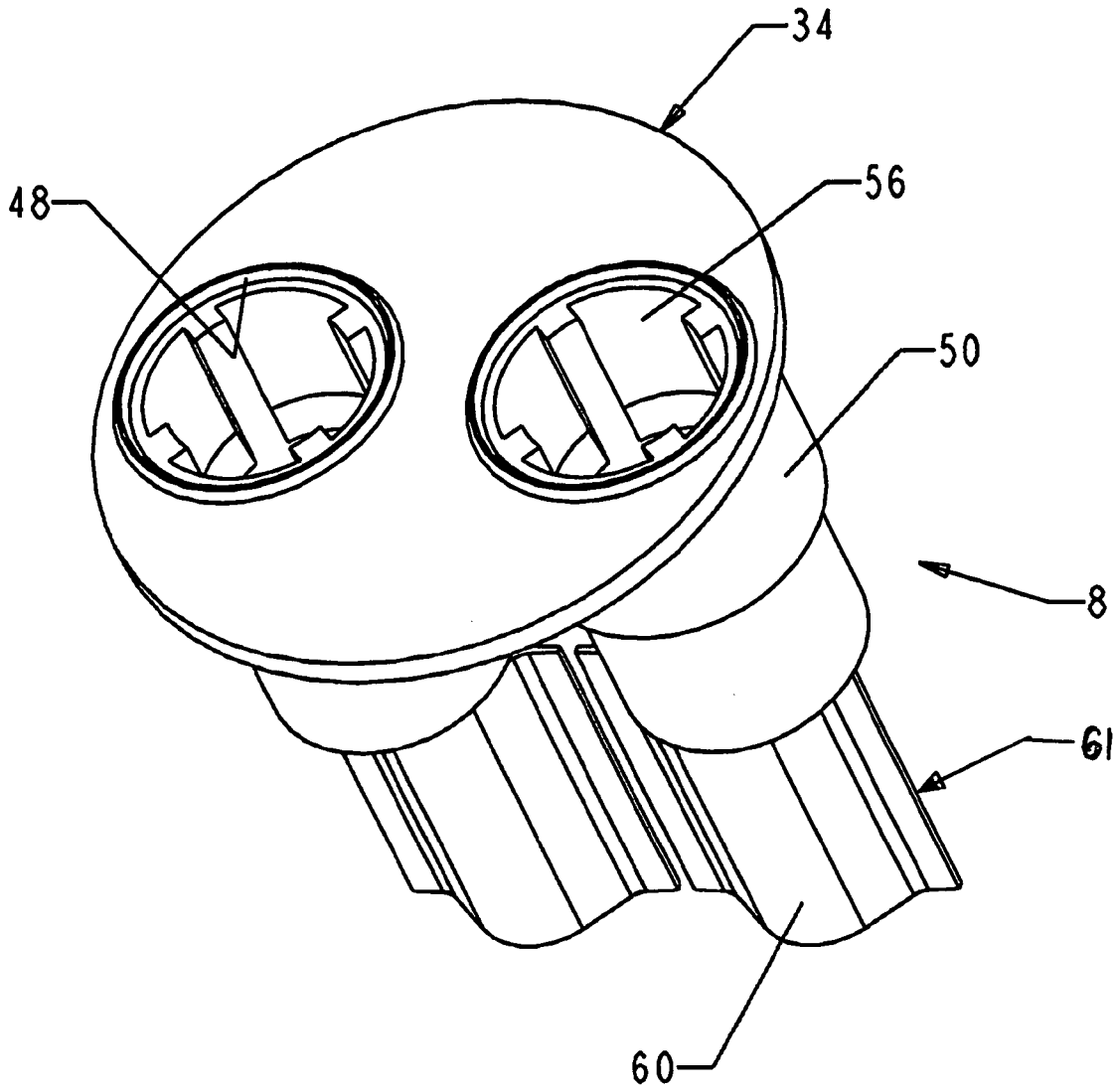
FIG. 12 is a top elevational perspective view of the valve stem assembly according to this invention.
Figure 13:
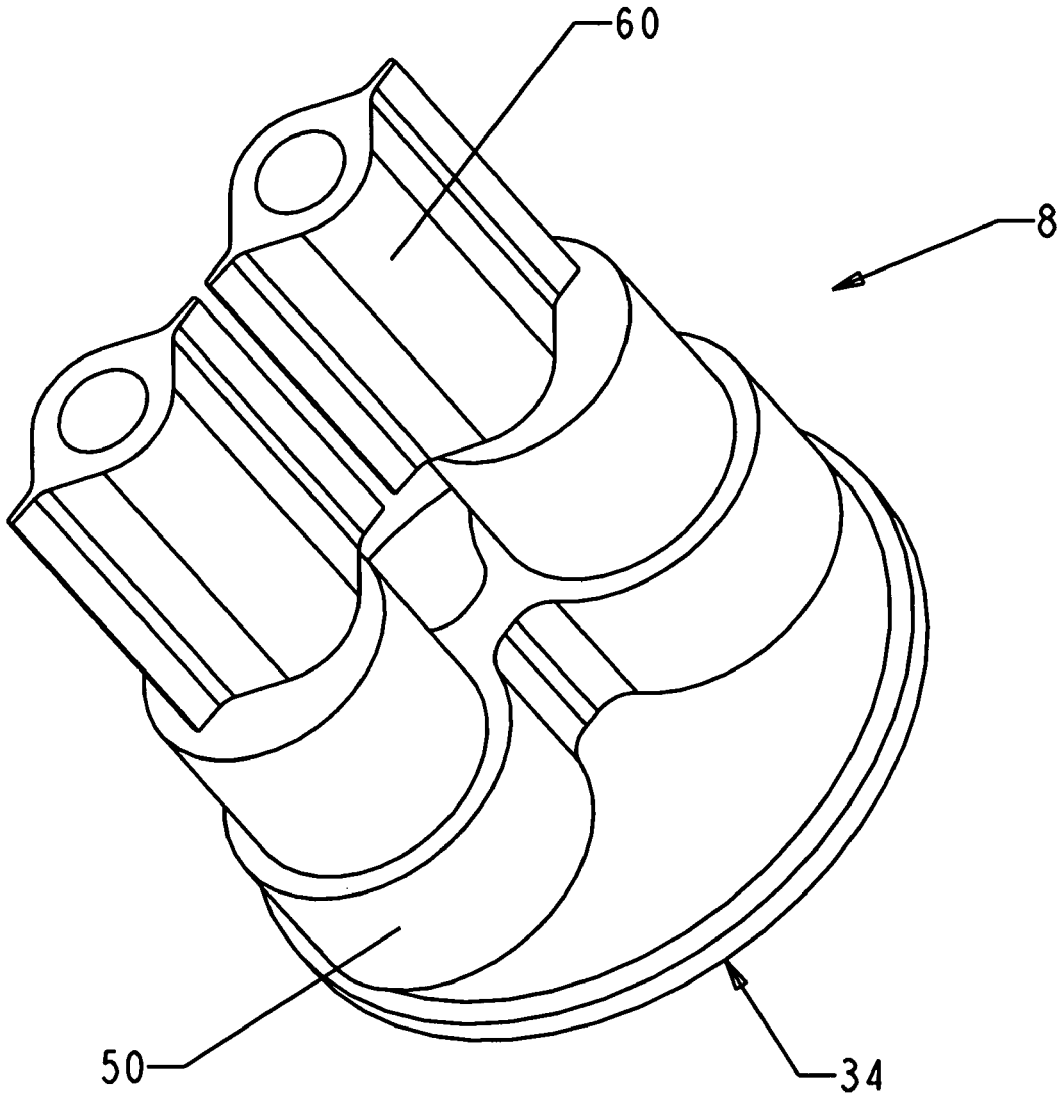
FIG. 13 is a bottom elevational perspective view of the valve stem assembly according to this invention.
Figure 14:
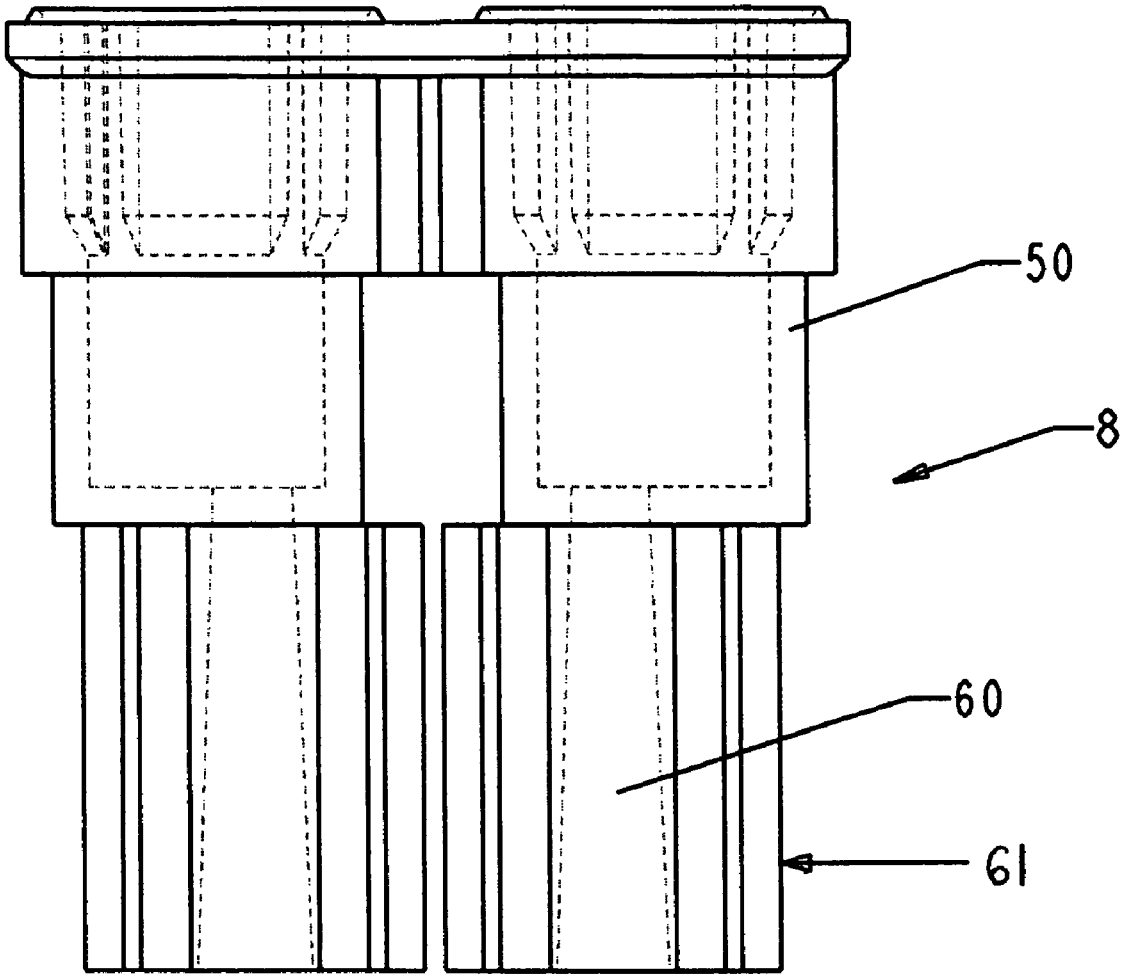
FIG. 14 is a front elevational view of the valve stem assembly according to this invention.

The present invention is directed to aerosol containers 2 having unified mounting cup and valve stem assemblies 4. Each of the mounting cup 6 and valve stem assembly 8 is new.

The mounting cup 6 is so sized as to fit into the conventional one-inch hole 10 in the dome 12 of aerosol containers 2.

The mounting cup 6 will be described with reference to FIGS. 1-6 and 15. The mounting cup 6 is made of metal, preferably tin or aluminum.

The mounting cup 6 has a flat central portion 14 having an upper surface 16 and a lower surface 18. The flat central portion 14 contains the appropriate number of holes 20 for accommodating the actuator(s) 22. The enclosed Figures illustrate mounting cups 6 containing two holes 20, but any number from one to four is possible and within the scope of the invention.

The flat central portion 14 has an inner perimeter 24. An inner section 26 proceeds downwardly from the inner perimeter 24. From the lower edge 28 of the inner section 26 an outer section 30 proceeds upwardly and abuts the inner section 26. The outer section 30 proceeds beyond the flat central portion 14. The combination of the inner section 26 and that portion of the outer section 30 below the flat central portion 14 constitutes the lower wall 32. The lower wall 32 is capable of being crimped onto the to-be-described flat circular upper piece 34 of the valve stem assembly 8. The upper portion 36 of the outer section 30 ends in a curved channel 38 adapted to fit over the bead 40 of a dome 12 of an aerosol container 2.

The preparation of the mounting cup 6 is carried out by presenting a round metal blank having the appropriate number of holes 20 therethrough; holding the central portion 14 of the blank firmly in place; bending the blank adjacent an inner perimeter 24 in a downward direction so that an inner section 26 is formed; bending the blank upwardly from the lower edge 28 of the inner section 26 so that an outer section 30 is formed which abuts the inner section 26 and goes beyond the central portion 14 of the blank; and bending the outer perimeter 42 of the blank to form a channel 38 which will fit over the bead 40 surrounding the one-inch hole 10 of the dome 12 of an aerosol container 2.

The valve stem assembly 8 will be described with reference to FIGS. 7-15.

The valve stem assembly 8 contains a flat circular upper piece 34 having an upper surface 44 and a lower surface 46. The circular upper piece 34 contains at least one hole 48, preferably from one to four holes 48 for accommodating actuators 22. For use with the above-described mounting cup 6, the number and placement of the holes 48 will be the same as in the mounting cup 6. Below the holes 48 in the flat circular upper piece 34 there is the desired number of valve bodies 50. When assembled, each valve body 50 will hold a valve plunger 52 and an upward biasing spring 54 which will bias the valve plunger 52 upward to a closed position. Each valve body 50 has at least one vertical passageway 56 and horizontal escape hole (not shown) to allow for the discharge of pressurized fluid when the actuator 22 is depressed. Each valve body 50 has a sealing gasket 58 to prevent discharge of pressurized fluid when the valve stem assembly 8 is in a closed condition. Below each valve body 50 there is a valve stem 60 for connection with a bag 62 or dip tube (not shown). Each valve stem 60 contains a set of fins 61 for a secure connection with the bag 62 or dip tube. The centers of the valve stems 60 are farther towards the center of the valve stem assembly 8 than are the centers of the valve bodies 50. This allows for the connection to collapsible bags 62 having offset connectors.

The preparation of the valve stem assembly 8 is carried out by injection molding of thermoplastic polymers, preferably Nylon or polyethylene. The injection molding is carried out by methods known in the art.

Figure 15:
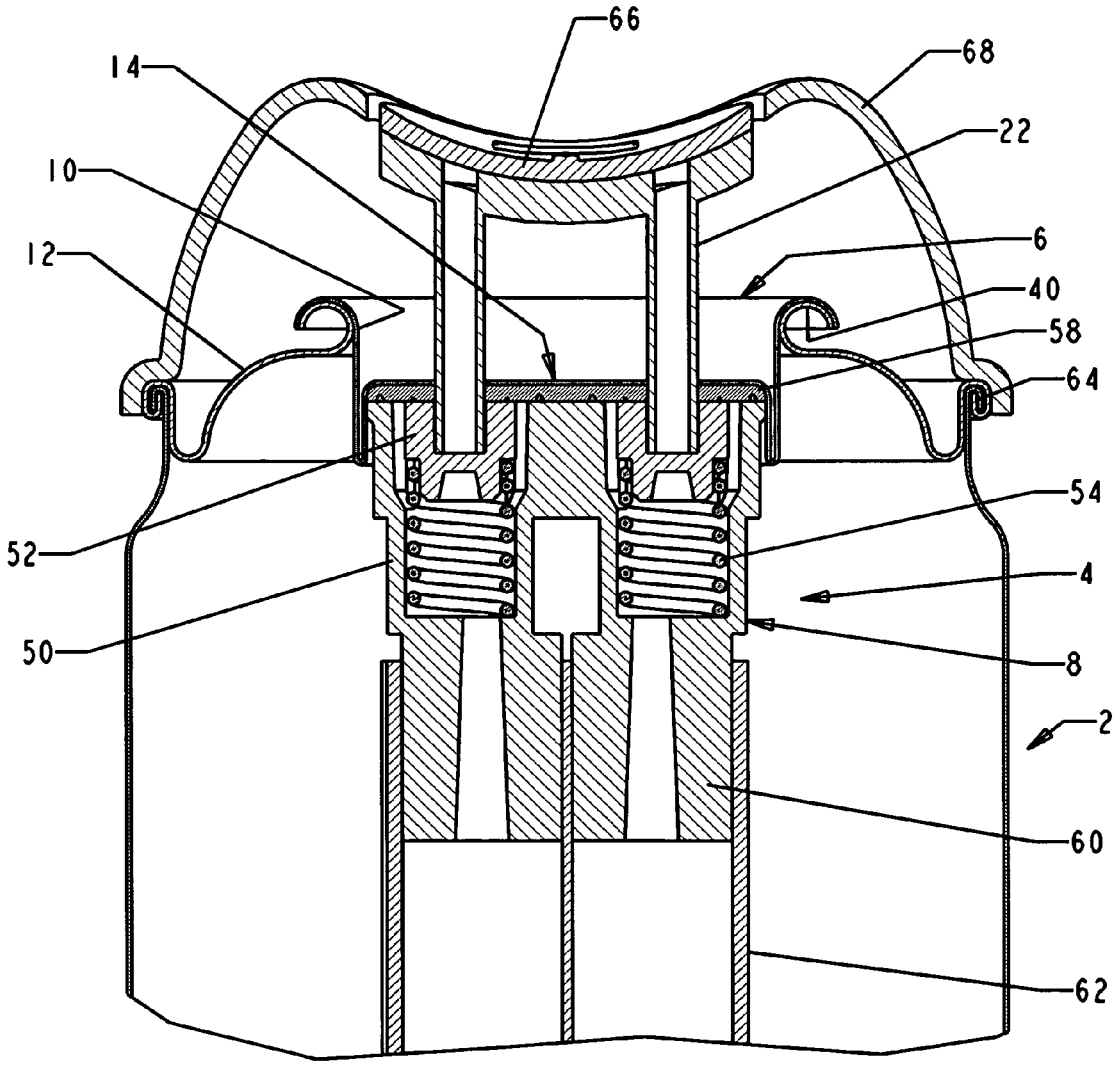
FIG. 15 is a front cross-sectional view of the unified mounting cup and valve stem assembly mounted in an aerosol container.
Figure 16:
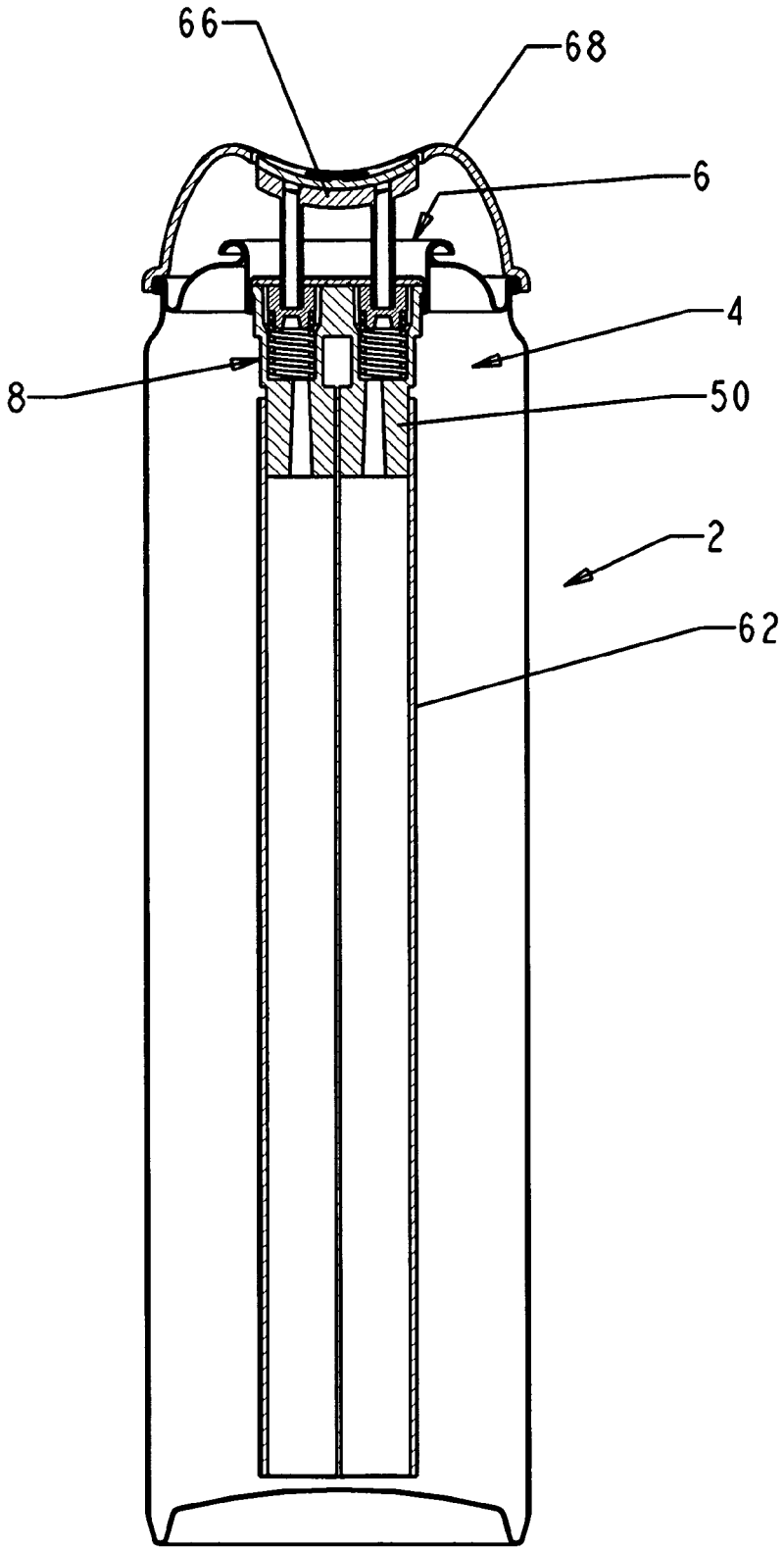
FIG. 16 is a front cross-sectional view of an aerosol can containing the unified mounting cup and valve stem of this invention in combination with two folded collapsible bags.

The unified mounting cup and valve stem assembly 4 will be described by reference to FIG. 15. The unified mounting cup and valve stem assembly 4 is made up of the mounting cup 6 and the valve stem assembly 8 wherein the lower surface 18 of the flat central portion 14 of the mounting cup 6 abuts with the upper surface 44 of the flat central upper piece 34 of the valve stem assembly 8 and the two parts are held together by crimping the lower wall 32 of the mounting cup 6 to the flat central upper piece 34 of the valve stem assembly 8.

The unified mounting cup and valve stem assembly 4 may be prepared by inserting an upward biasing spring 54 and an appropriate male or female valve plunger 52 into each valve body 50, applying a sealing gasket 58 to the valve stem assembly 8, bringing the upper surface 44 of the flat central upper piece 34 of the thus-prepared valve stem assembly 8 into contact with the lower surface 18 of the flat central portion 14 of the mounting cup 6 so that the holes 20, 48 are aligned, and crimping in a known manner the lower wall 32 of the mounting cup 6 so that the lower surface 18 of the flat central portion 14 of the mounting cup is 6 held to the upper surface 44 of the flat circular upper piece 34 of the valve stem assembly 8.

The channel 38 of the mounting cup 6 may be crimped to the bead 40 surrounding the one-inch hole 10 in a dome 12 for an aerosol container 2. The valve stem(s) 60 may then be attached to appropriate collapsible bags 62 or dip tubes. Any collapsible bags 62 may be filled with the desired product. The dome 12 of the thus-prepared assembly 4 may then be secured to the top edge 64 of an aerosol container 2. Aerosol propellant may be introduced into the container 2 by conventional methods and the actuators 22, mixing device 66, and caps 68 may be secured.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A mounting cup for an aerosol container comprising, a flat central portion having an upper surface, a lower surface, an inward perimeter, and an outer edge, the flat central portion having at least two holes for at least two actuators; an inner section extending downwardly from the inner perimeter, the inner section having a lower edge; an outer section extending upwardly from the lower edge of the inner section, the outer section abutting with the inner section, the outer and inner sections forming a lower wall below the flat central portion, and the outer section extending as an upper portion above the flat central portion; and the upper portion ending in a curved channel adapted to fit over a bead of a dome of an aerosol container.

2. A valve stem assembly for an aerosol container comprising, a flat circular upper piece having an upper surface, a lower surface, and at least two holes for at least two valve actuators; a corresponding number of valve bodies opening into the at least two holes, each valve body capable of holding a biasing spring and a valve plunger; and a corresponding number of valve stems opening into the valve bodies.

3. The valve stem assembly of claim 2, wherein each valve stem contains fins.

4. A unified mounting cup and valve stem assembly suitable for use in an aerosol container comprising, a) a mounting cup comprising a flat central portion having an upper surface, a lower surface, an inward perimeter and an outer edge, the flat central portion having at least two holes for at least two actuators; an inner section extending downwardly from the inner perimeter, the inner section having a lower edge; an outer section extending upwardly from the lower edge of the inner section, the outer section abutting with the inner section, the outer and inner sections forming a lower wall below the flat central portion, and the outer section extending as an upper portion above the flat central portion; and the upper portion ending in a curved channel adapted to fit over a bead of a dome of an aerosol container and b) a valve stem assembly comprising a flat circular top piece containing at least two holes for at least two actuators, a corresponding number of valve bodies opening into the at least two holes, each valve body containing a biasing spring and a valve plunger; and a corresponding number of valve stems below the valve bodies.

5. The unified mounting cup and valve stem assembly of claim 4, wherein the mounting cup and the valve stem assembly are held together by crimping of the lower wall of the mounting cup.

6. The unified mounting cup and valve stem assembly of claim 4, wherein each valve stem contains fins.

7. An aerosol container comprising, a dome containing a bead and a unified mounting cup and valve stem assembly crimped to the bead, the unified mounting cup and valve stem assembly comprising, a) a mounting cup comprising a flat central portion having an upper surface, a lower surface, an inward perimeter and an outer edge, the flat central portion having at least two holes for at least two actuators; an inner section extending downwardly from the inner perimeter, the inner section having a lower edge; an outer section extending upwardly from the lower edge of the inner section, the outer section abutting with the inner section, the outer and inner sections forming a lower wall below the flat central portion, and the outer section extending as an upper portion above the flat central portion; and the upper portion ending in a curved channel which is fit over the bead of the dome of the aerosol container and b) a valve stem assembly comprising a flat circular top piece containing at least two holes for at least two actuators, a corresponding number of valve bodies opening into the at least two holes, each valve body containing a biasing spring and a valve plunger; and a corresponding number of valve stems below the valve bodies.

8. The aerosol container of claim 7, wherein the mounting cup and the valve stem assembly are held together by crimping of the lower wall of the mounting cup.

9. The aerosol container of claim 7, wherein each valve stem contains fins.

10. The aerosol container of claim 7, wherein at least one valve stem is connected to a collapsible bag.

* * * * *